US006367093B1

(12) United States Patent
Hawro

(10) Patent No.: US 6,367,093 B1
(45) Date of Patent: Apr. 9, 2002

(54) WATER CLOSET BOWL BOTTOM CONNECTION

(76) Inventor: Edward Hawro, 44 Bedford Ave., Buffalo, NY (US) 14216

( * ) Notice: Subject to any disclaimer, the term of this patent is extended or adjusted under 35 U.S.C. 154(b) by 0 days.

(21) Appl. No.: 09/757,780

(22) Filed: Jan. 11, 2001

(51) Int. Cl.[7] ..... E03D 11/16
(52) U.S. Cl. ..... 4/252.1
(58) Field of Search ..... 4/252.1–252.6; 411/395

(56) References Cited

U.S. PATENT DOCUMENTS 2,443,343 A * 6/1948 Crocker ..... 411/395 X
3,180,660 A * 4/1965 Brewington ..... 4/252.4 X

* cited by examiner

*Primary Examiner*—Charles E. Phillips
(74) *Attorney, Agent, or Firm*—Wallace F. Neyerlin

(57) ABSTRACT

An improved connection of a toilet bowl to the floor over which the bowl is located utilizing the combination of an externally threaded toilet bolt with a head and a hollow shaft down its axis, a screw of longer length than the toilet bowl and positioned down the axial hollow shaft of the toilet bowl, and a flange positioned between the toilet bowl and the floor, said flange having an opening therein capable of receiving the head of the toilet bolt.

The hollow shaft down the axis of the toilet bolt may be cylindrical or polygonal in shape.

The method of making the improved connection is also described.

4 Claims, 2 Drawing Sheets

WATER CLOSET BOWL BOTTOM CONNECTION

BACKGROUND OF THE INVENTION

1. Field of the Invention

This invention relates to water closets and has for its principal object the provision of a new and improved firm connection of the water closet or toilet bowl to the floor over which it is located.

A problem frequently encountered after the installation of a toilet is the loosening of toilet bolts due to deflection of the toilet flange after frequent usage. A toilet flange may bend or break from the constant pull on the toilet mounting bolts, allowing movement of the toilet and compromising the gasket seal between the bottom of the flange and the floor over which the toilet is located. Such movement can result in subsequent leakage of sewer gas and/or water and also rotted floors underneath toilets.

It is a principal object of this invention to minimize or prevent such movement of the toilet bowl.

It is another object of this invention to prevent rotted floors underneath toilets.

It is another object of this invention to accomplish the foregoing objectives and overcome the problems indicated in a very economical manner and in a manner that can be readily or easily carried out by homeowners, plumbers, or by handy "do-it yourselves."

2. Description of the Related Art

A search was carried out in the U.S. Patent Office to investigate the novelty of the idea of this invention.

Two U.S. Patients, U.S. Pat. Nos. 3,180,660 and 4,846,622 were selected as those considered the most pertinent to the concepts and features of the present invention. These patents were thoroughly reviewed and are not considered anticipatory of the present invention.

SUMMARY OF THE INVENTION

A toilet bolt with a hollow shaft down its axis is one of the principal features of the present invention. Its utilization in the manner hereinafter described is a key means which makes possible the desired new and improved firm connection of the water closet or toilet bowl to the floor over which the toilet bowl is located.

Toilet bolts used in this invention will typically be made of plastic or metal such as brass and may vary in length and diameter. A typical length would be about 2½ inches and a typical diameter would be about ⅜ of an inch to about 25/64 of an inch; or of sufficient diameter that a shaft down its axis can be hollowed out and the bolt will still retain sufficient strength to accomplish the purpose of this invention. This hollowed shaft need not be circular; a square or hexagonal or star-shaped shaft, i.e. polygonal shaft would allow the bolt to be held by an allen wrench or square drive bit to prevent the bolt from rotating during removal of the nut holding down the toilet.

A screw is used down the axial hollow shaft of the bolt and screws into the floor beneath the toilet bowl and assists greatly in firming up the connection of the toilet flange and the gasket under the flange to the floor over which the toilet bowl is located. This effects a more secure installation since a toilet flange may bend or break from the constant pull of the toilet mounting bolts, allowing movement of the toilet bowl and compromising the seal. The screws used will typically be about ¾ to 1½ inch longer than the toilet bolt and are of uniform cross-sectional dimension down the entire length of same.

HOW THE IDEA WORKS

The bolts are installed in the slot of the toilet flange as in the customary practice. The toilet bowl is positioned over the bolts. Now a screw is inserted into the hollow shaft of the toilet bolt and driven into the floor beneath the flange. A preferred procedure is to first put the toilet bowl in place and start the screws without the gasket. The screws are driven fully into the floor and then the gasket is inserted over the horn of the toilet bowl or on top of the flange and the toilet bowl is put back into place.

A better and more complete understanding of the invention will be made clear from a review of the drawings and the description thereof.

DETAILED DESCRIPTION OF THE DRAWINGS

Figure 1A:
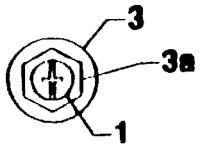
FIG. 1*a* is a top cross-sectional view of the screw, nut, washer portion of the connection.
Figure 2A:
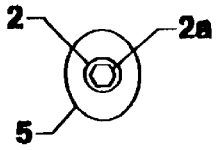
FIG. 2*a* is a cross-sectional view of a different type of hollow axial shaft arrangement, i.e. hexagonal instead of circular.
Figure 1:
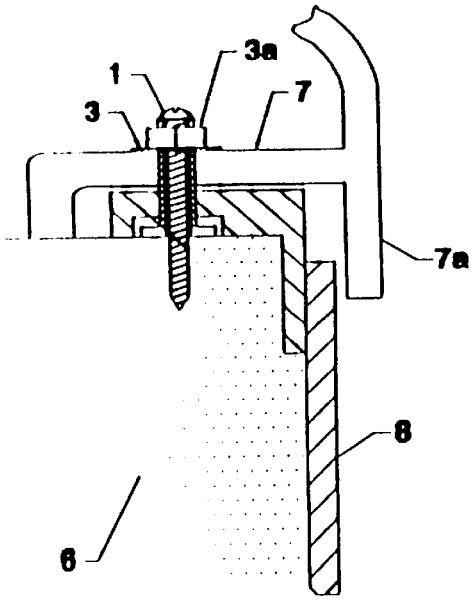
FIG. 1 is a cross-sectional view of a completed right portion of the toilet bowl to floor connection of the present invention.
Figure 2:
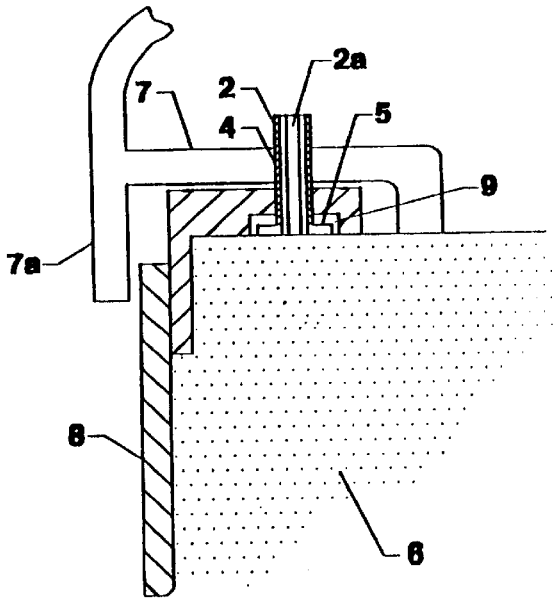
FIG. 2 is a cross-sectional view of an incomplete connection of the left portion of the toilet bowl to the floor, illustrated to help describe how the connections of this invention are carried out.
Figure 3:
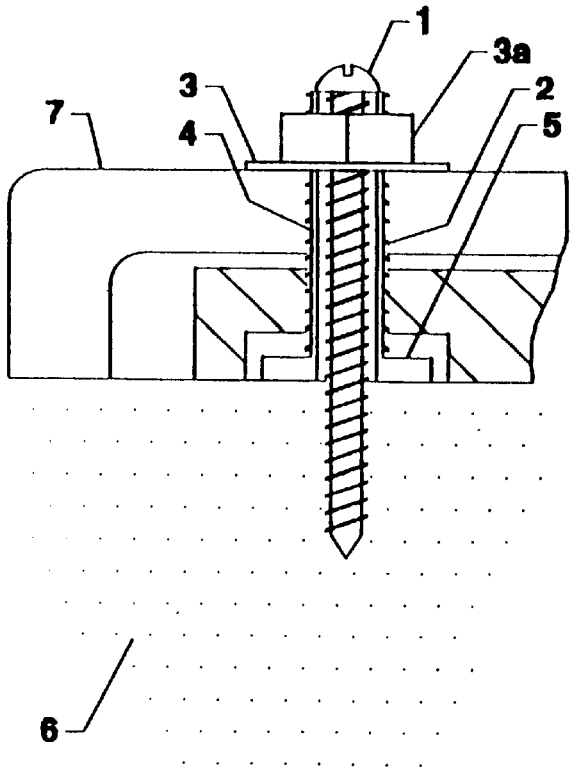
FIG. 3 shows a completed left portion of the toilet bowl to floor connection of the present invention, using the same type of arrangement as illustrated in FIG. 1.

In FIGS. 1, 2 and 3, numeral 1 designates a screw used to go down through the hollow axial shaft 2*a* of externally threaded toilet bolt 2. Numeral 3 designates a washer under nut 3*a* which holds the toilet 7 firmly in place. Numeral 4 designates the external threads of toilet bolt 2. Numeral 5 designates the elongated head of the toilet bolt 2. Numeral 6 designates the sub-floor beneath the toilet into which the bottom end of screw 1 is threaded. Numeral 7*a* designates the horns or sides of the toilet bowl discharge hole. Numeral 8 designates the soil pipe into which the toilet bowl flushes.

Figure 3A:
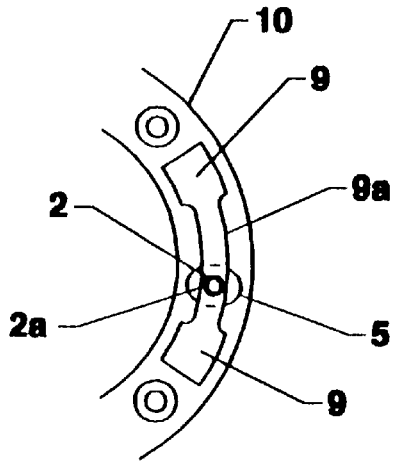
FIG. 3*a* is a plan view of how the elongated head of the toilet bolt is inserted into the arcuate flange of the toilet bowl to floor connection.

In FIG. 3*a*, numeral 10 is a broken partial view of a brass or plastic flange, which is typically employed to fasten a toilet to the soil pipe and floor. The brass or plastic flange 10 has an opening 9 therein into which the elongated head 5 of the toilet bolt is inserted after which the head of the bolt may be maneuvered into position away from the opening 9 in the arcuate slot 9*a* of the flange 10.

FIGS. 1 and 3 indicate completed connections of the toilet bowl to the floor, screw 1 having been completely threaded into the sub-floor 6.

FIG. 2 is set-forth to help more fully explain the makings of the connections of this invention. Externally threaded bolt 2 has had its axis bored out to create a hollow shaft 2*a*. The machining of this may be by drill to create a circular cross-sectional hollow shaft, as in FIGS. 1 and 3, wherein the head of the screw can be tightened by means of a conventional screw driver. Or the hollowing out of bolt 2 can be accomplished by other machining means, so that the screw can be, for example, hexagonal in shape as shown in FIG. 2*a* and tightened into place by means of an alien wrench, also permitting the bolt to be held by an alien wrench while tightening or loosening the nut holding down the toilet.

The foregoing description of the invention and uses thereof are intended to illustrate the invention without limiting it thereby. It will be understood that various modifications can be made in the invention without departing from the spirit or scope thereof.

I claim:

1. A means for making an improved connection of a toilet bowl to the floor over which the toilet bowl is located, said means comprising the combination of:

A. an externally threaded toilet bolt with a head and a hollow shaft down its axis;

B. a screw of longer length than the toilet bolt and positioned down the axial hollow shaft of the toilet bolt; and C. a flange positioned between the toilet bowl and the floor, said flange having an opening therein capable of receiving the head of the toilet bolt.

2. A means of making an improved connection according to claim 1 wherein the toilet bolt of paragraph A is inserted through an opening in the base of the toilet bowl, the head of the toilet bowl bolt is positioned in the opening of the flange of paragraph C under the toilet bowl and the screw of paragraph B is screwed through the flange and into the floor under the toilet bowl.

3. A means for making an improved connection according to claim 1 wherein the hollow shaft down the axis of the toilet bolt is cylindrical in shape.

4. A means for making an improved connection according to claim 1 wherein the hollow shaft down the axis of the toilet bolt is polygonal in shape.

* * * * *